US006398212B1

(12) United States Patent
Miyake

(10) Patent No.: US 6,398,212 B1
(45) Date of Patent: Jun. 4, 2002

(54) SHEET SURFACE REVERSING DEVICE AND IMAGE FORMING APPARATUS HAVING THE SAME

(75) Inventor: Hiroaki Miyake, Moriya-machi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/461,762

(22) Filed: Dec. 15, 1999

(30) Foreign Application Priority Data

Dec. 18, 1998 (JP) ..... 10-361508

(51) Int. Cl.[7] ..... B65H 29/60
(52) U.S. Cl. ..... 271/186; 271/291; 271/303
(58) Field of Search ..... 271/186, 65, 291, 271/303

(56) References Cited

U.S. PATENT DOCUMENTS

| | | | | |
|---|---|---|---|---|
| 4,234,305 A | | 11/1980 | Miyake et al. | 432/59 |
| 4,958,828 A | * | 9/1990 | Saito | 271/186 |
| 5,150,167 A | * | 9/1992 | Gonda et al. | 271/186 |
| 5,775,686 A | | 7/1998 | Miyake | 271/127 |
| 6,129,349 A | * | 10/2000 | Olbrich et al. | 271/186 |
| 6,186,496 B1 | * | 2/2001 | Marasco et al. | 271/186 |

FOREIGN PATENT DOCUMENTS

| | | |
|---|---|---|
| JP | 59-118482 | 7/1984 |
| JP | 63-295357 | 12/1988 |
| JP | 5-51158 | 3/1993 |
| JP | 5-323730 | 12/1993 |
| JP | 6-38838 | 10/1994 |
| JP | 8-081105 | 3/1996 |
| WO | WO 98/17570 | 4/1998 |

* cited by examiner

*Primary Examiner*—Christopher P. Ellis
*Assistant Examiner*—Mark A. Deuble
(74) *Attorney, Agent, or Firm*—Fitzpatrick, Cella, Harper & Scinto

(57) ABSTRACT

A sheet surface reversing device includes a sheet conveying path through which a sheet is conveyed, a reverse feeding device for reversely feeding the sheet conveyed through the sheet conveying path, a sheet surface reverse conveying path for directing the sheet reversely fed from the reverse feeding device branched from the sheet conveying path, and a conveying path changing member rotatably disposed at a branched portion between the sheet conveying path and the sheet surface reverse conveying path. When a distal end of the conveying path changing member abuts against an inner wall of the sheet conveying path, the distal end of the conveying path changing member guides the sheet to be reversely fed into the sheet surface reverse conveying path. In addition, an interference avoiding device is provided for avoiding interference between the sheet reversely fed and the distal end of the conveying path changing member on the inner wall of the sheet conveying path.

17 Claims, 10 Drawing Sheets

SHEET SURFACE REVERSING DEVICE AND IMAGE FORMING APPARATUS HAVING THE SAME

BACKGROUND OF THE INVENTION

1. Field of the Invention

The present invention relates to a sheet surface reversing device for reversing a front surface and a back surface of a sheet by feeding the sheet reversely on the way of conveyance of the sheet along a conveying direction, and an image forming apparatus having such a sheet surface reversing device, such as a copying machine, a facsimile, a printer or combination thereof.

2. Related Background Art

Conventionally, for example, in a sheet surface reversing device incorporated into a copying machine, a rotary member generally called a flapper has been rotated by a solenoid to switch a sheet conveying direction. And, a technique in which an elastic member is provided on a distal end of the flapper is also well-known.

Incidentally, the sheet may include a normal paper (plain paper), a resin sheet having a small thickness (as a substitute article for the normal paper), a post card, a paper board, an envelope, a plastic thin film or the like.

FIG. 8 shows an example of a sheet surface reversing device, in which an elastic member made of Mylar (trade name), for example, is used for a guide piece (conveying path switching member) 101 of a rotary member 100. In FIG. 8, a sheet enters from a direction B1, and the sheet can be switched toward a direction C1 by rotating forwardly and reversely surface reverse rollers 104 and by abutting the guide piece 101 serving as a valve against a wall of the convey path. However, in the example of FIG. 8, as shown in FIG. 9, during the reversing operation for the sheet, in dependence upon a condition of the sheet (curl, rigidity and/or material), a leading end of the sheet may be caught by a distal end of the guide piece 101, with the result that the leading end of the sheet may be folded or the sheet may be jammed at worst.

Another conventional example is disclosed in Japanese Utility Model Publication No. 6-38838, for example. FIG. 10 shows a characteristic portion of such another example, in which a distal end of an elastic guide piece 101 is protruded outwardly through a hole 105 formed in a guide plate 103. With this arrangement, during the reverse feed of the sheet, the leading end of the sheet can be prevented from being caught by the distal end of the guide piece 101.

Further, a further conventional example is disclosed in Japanese Patent Application Laid-Open No. 59-118482. FIG. 11 shows a characteristic portion of such an example. After a sheet passed between guide portions 112 and 113 is conveyed in a direction indicated by the arrow a, the sheet is conveyed by a surface reverse roller (not shown) in a direction indicated by the arrow b. Above the guide portion 112, there are disposed a guide portion 110 and an elastic guide piece 111 attached to the guide portion 110. The guide piece 111 has a pectination (comb) shape and comprises protruded portions 111*a* and recessed portions 111*b*, and distal ends of the protruded portions 111*a* block or close a conveying path defined between the guide portions 112 and 113 and are located at a sunken position lower than a plane of the guide portion 113 extending along the arrow b. With this arrangement, when the sheet is conveyed in the direction indicated by the arrow a, the sheet can easily advance while pushing out the protruded portions 111*a*; whereas, when the sheet is conveyed in the direction indicated by the arrow b, the sheet is offered to be prevented from entering into the conveying path between the guide portions 112 and 113 and the leading end of the sheet is offered to be prevented from being caught.

However, the above-mentioned conventional examples have the following disadvantages.

First of all, in the example shown in FIG. 10, if the elastic guide piece 101 has a uniform shape (for example, rectangular shape) over the entire length in the longitudinal direction, the corresponding hole 105 also extends continuously along the length of the guide piece 101. As a result, depending upon the curled state of the sheet, the leading end of the sheet being conveyed may be caught by the hole 105 or the sheet may escape out of the guide portion. In order to avoid this, an arrangement as shown in FIG. 12 can be considered.

A guide piece 101 has a pectination (comb) shape and comprises protruded portions 101*b* and recessed portions 101*a*, and a guide plate 103 opposed to the protruded portions 101*b* is provided with holes 105 which is associated with the protruded portions 101*b* and into which free ends of the corresponding protruded portions 101*b* are inserted. By providing such holes 105 divided along the longitudinal direction, even when a sheet S is advanced from a direction indicated by the arrow B1, the sheet S can be prevented from escaping outside through the holes. Further, in order to switch the conveying path, side edges of a sheet S which is apt to be caught (for example, in FIG. 12, side edges of a sheet having A4 size or B5 size) are passed positions off the holes 105 (over the recessed portions 101*a*).

However, even with the arrangement as shown in FIG. 12, due to skew-feed of the sheet for any reason or in dependence upon the curled state of the sheet, the sheet may be caught by the recessed portion 101*a* or the hole 105, and, thus, adequate reliability is not ensured.

Further, in the example shown in FIG. 11, since the recessed portions 111*b* of the guide piece 111 are spaced apart from a stepped portion of the guide 113 more or less, the same problem that the leading end of the curled sheet is apt to be caught arises. Further, since the pectination shape is used, the rigidity is reduced to easily cause deformation, with the result that the protruded portions 111*a* may be floating from the stepped portion to catch the sheet.

SUMMARY OF THE INVENTION

An object of the present invention is to provide a sheet surface reversing device in which a sheet is prevented from being jammed due to interference between a leading end of the sheet conveyed reversely and a distal end of a conveying path changing member, and stable sheet conveyance can be achieved, and an image forming apparatus having such a sheet surface reversing device.

To achieve the above object, according to the present invention, there is provided a sheet surface reversing device comprising a sheet conveying path through which a sheet is conveyed, reverse feeding means for reversely feeding the sheet conveyed through the sheet conveying path, a sheet surface reverse conveying path for directing the sheet reversely fed from the reverse feeding means, and a conveying path changing member rotatably disposed at a branched portion between the sheet conveying path and the sheet surface reverse conveying path, wherein, in a state that a distal end of the conveying path changing member abuts against an inner wall of the sheet conveying path, the distal end guides the sheet to be reversely fed into the sheet surface reverse conveying path, and wherein interference avoiding means for avoiding interference between the sheet reversely fed and the distal end of the conveying path changing member are provided on the inner wall of the sheet conveying path.

With this arrangement, when the sheet is reversely fed by the reverse feeding means, the rotating distal end of the conveying path changing member abuts against the inner wall of the sheet. conveying path, and the interference avoiding means conceals the rotating distal end not to be seen from the reverse feeding means. Thus, the interference avoiding means can cause a leading end of the sheet reversely fed (trailing end of the sheet conveyed through the sheet conveying path) to pass over the rotating distal end of the conveying path changing member thereby to avoid the interference between the leading end of the sheet and the rotating distal end of the conveying path changing member, thereby guiding the sheet reversely fed into the sheet surface reverse conveying path smoothly. In this way, the sheet can be prevented from being jammed due to the changing of the conveying path changing member.

In the present invention, preferably, the conveying path changing member may include a rotary member provided at the branched portion, and an elastic guide member provided on the rotary member and capable of abutting against the inner wall.

With this arrangement, since the guide member abutting against the inner wall of the sheet conveying path is an elastic member, a rotating distal end of the guide member is closely contacted with the inner wall of the sheet conveying path not to protrude from the interference avoiding means, thereby enhancing the sheet jam preventing effect.

Further, in the present invention, preferably, a longitudinal configuration of the guide member may be made substantially uniform so that the guide member abuts against the inner wall throughout the longitudinal length of the guide member.

With this arrangement, since the guide member has the substantially uniform configuration, the sheet cannot be caught by the guide member and the guide member itself is deformless, and, thus, stable performance can be achieved.

DETAILED DESCRIPTION OF THE PREFERRED EMBODIMENTS

Now, an embodiment of the present invention will be explained with reference to FIGS. 1 to 5.

Figure 1:
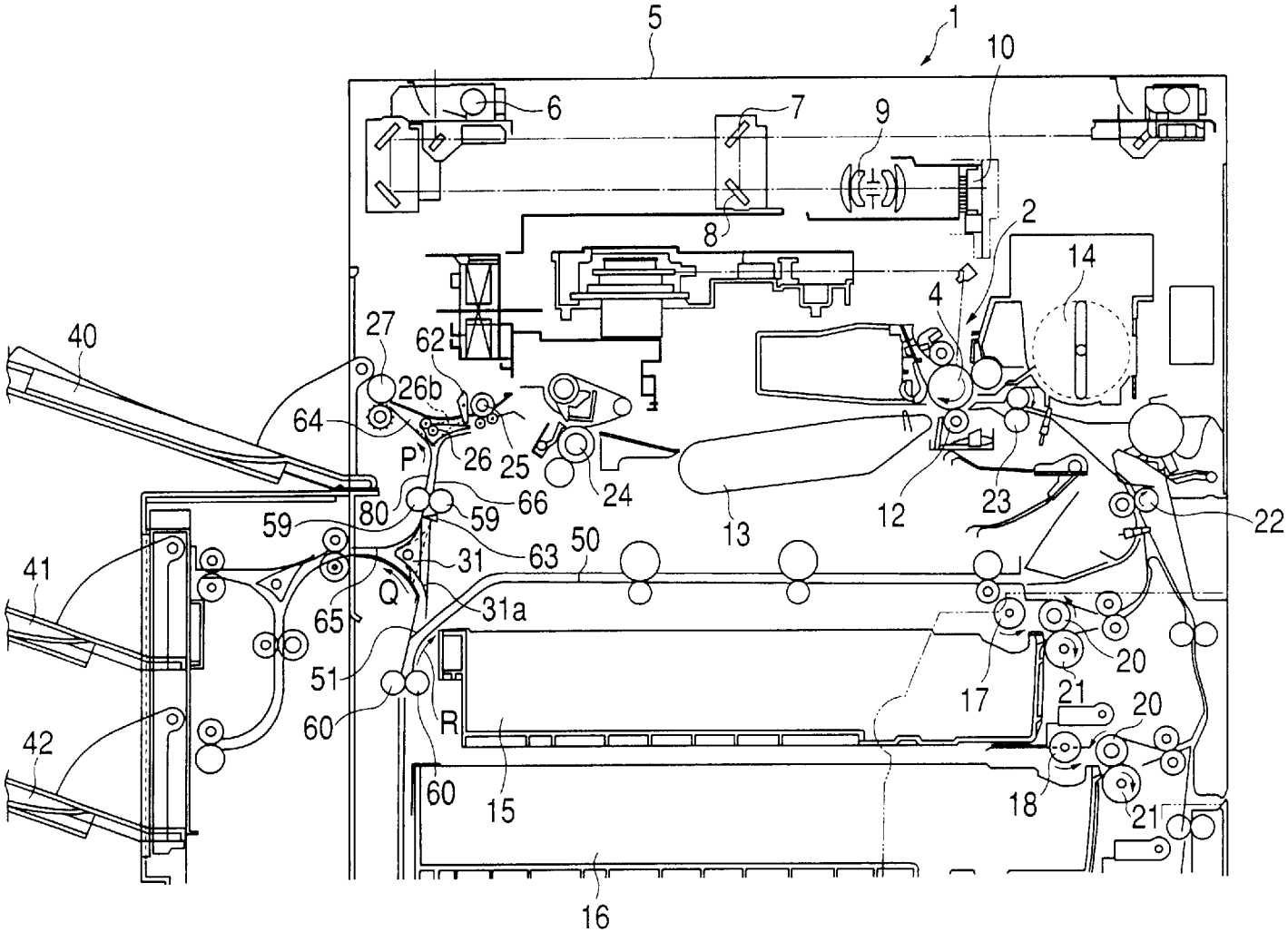
FIG. 1 is a schematic front sectional view of a copying machine as an image forming apparatus having a sheet surface reversing device.

In FIG. 1, a copying machine (image forming apparatus) 1 is a both-face copying machine capable of forming images on both surfaces of a single sheet.

First of all, an operation for forming an image on a sheet will be briefly described.

The copying machine 1 includes cassettes 15, 16 in which a plurality of sheets are stacked. The sheets having different sizes and stacked in the cassettes 15, 16 are selectively fed to a transfer portion.

The sheets stacked in the cassettes 15, 16 are sequentially picked up from uppermost ones by pick-up rollers 17, 18 rotated in directions indicated by the arrows. The sheets S fed out by the pick-up roller 17 or 18 are separated one by one by a pair of separating rollers 20, 21 rotated in directions indicated by the arrows, and the separated sheet is fed to a second pair of registration rollers 22 and a pair of registration rollers 23 which are now stopped.

When a leading end of the sheet S fed by the pair of separating rollers 20, 21 abuts against a nip between the pair of registration rollers 22, a predetermined loop is formed in the sheet, thereby correcting skew-feed of the sheet.

The sheet S of which the skew-feed is corrected is sent to a transfer portion between a photosensitive drum 4 and a transfer charger 12 by the pair of registration rollers 23 which start to be rotated in directions indicated by the arrows at a timing for registering the sheet with a toner image formed on the photosensitive drum 4 rotated in a direction indicated by the arrow. At the transfer portion, the toner image formed on the photosensitive drum 4 is transferred onto the sheet S by the transfer charger 12. The photosensitive drum 4, the transfer charger 12 and the developing device 14 constitute image forming means 2 forming an image on the sheet.

Incidentally, in the copying machine, an image on an original (not shown) rested on a platen glass 5 is read by a CCD 10 through an optical system comprising an illumination lamp 6, reflection mirrors 7, 8 and a zoom lens 9, and read data is subjected to predetermined image processing so that a laser beam from a laser scanner is illuminated onto the photosensitive drum 4 rotated in the direction indicated by the arrow. An electrostatic latent image formed on the photosensitive drum 4 in this way is visualized by toner supplied from the developing device 14 to form a toner image.

The sheet S to which the toner image is transferred at the transfer portion is sent, by a conveying belt 13, to a fixing device 24, by which the toner image is fixed onto the sheet.

After the toner image is fixed on the sheet S, in a one-face copying mode and in a face-up discharging mode, the sheet S from the fixing device is sent to a pair of sheet discharge outer rollers 27 by a sheet discharge inner roller 25 and then is discharged by the pair of sheet discharge outer rollers 27 onto a discharge sheet tray 40 out of the machine in a state that the imaged surface of the sheet faces upwardly. In this case, a flapper 26 disposed at a branched portion has been switched or changed to a position 26*a* shown by the two dot and dash line in FIG. 2.

Figure 2:
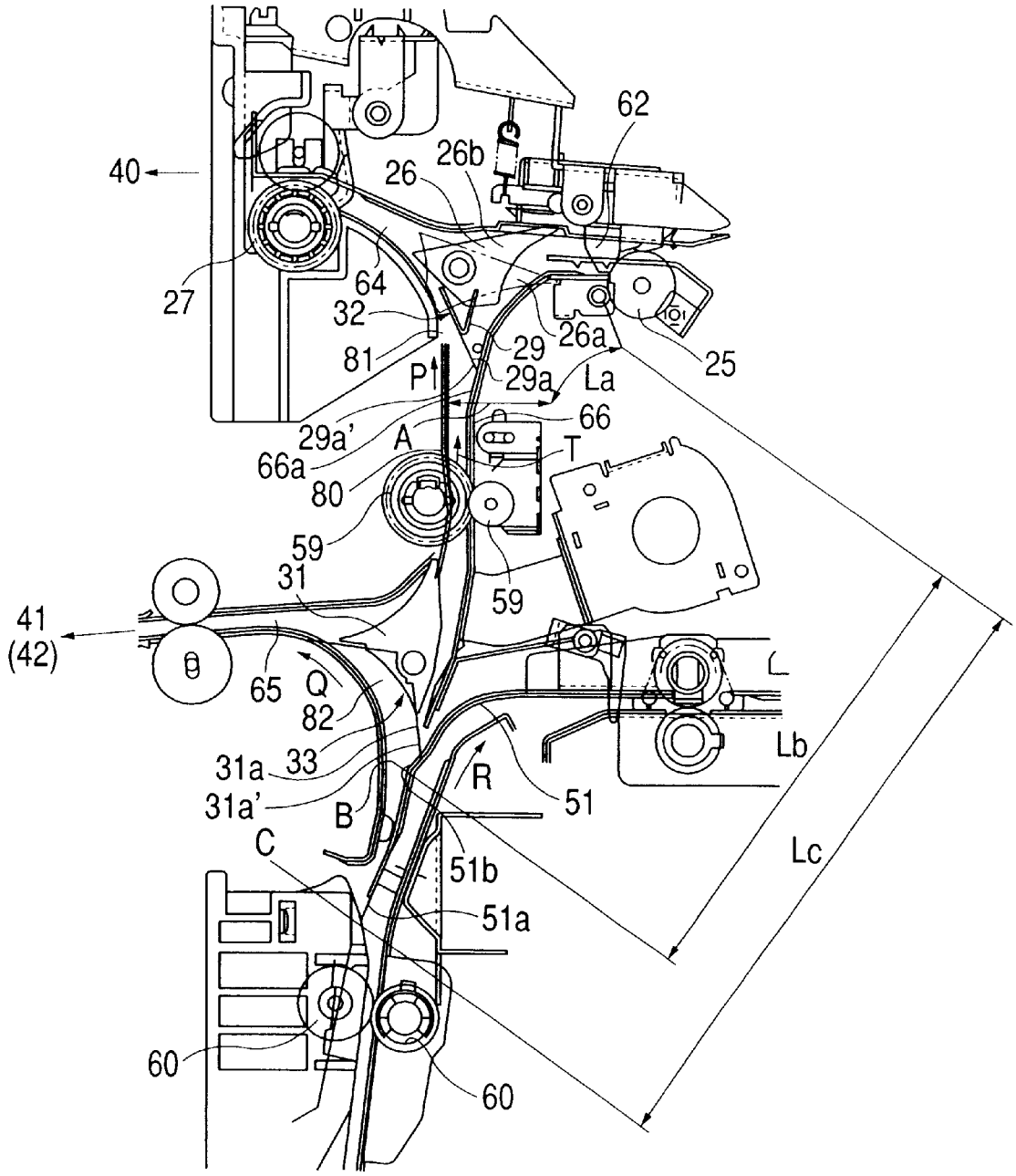
FIG. 2 is a schematic front sectional view of the sheet surface reversing device.

In the illustrated embodiment, although face-up discharge sheets, face-down discharge sheets and both-face discharge sheets can be discharged onto each of three bin trays, the characteristic of the present invention is a surface reverse method for reversing a front surface and a back surface of the sheet during the conveyance of the face-down discharge sheet onto the three bin trays 40, 41, 42 and during the conveyance of the sheet onto a both-face tray 50. Three surface reverse positions are used. Now, concrete flow of the sheet will be described with reference to FIG. 2 showing the surface reverse portions in detail.

As forward and reverse rotatable reverse feeding means, two pairs of rollers, i.e., a pair of first surface reverse rollers 59 and a pair of second surface reverse rollers 60 are provided in a sheet conveying path 80. The pairs of rollers are controlled by discrete stepping motors. Further, the sheet conveying path 80 is provided with a fixing discharge sheet sensor 62 as a sensor for sheet detection and control.

Incidentally, the sheet conveying path 80 serves to guide the sheet fed from the image forming means 2 to the pair of second surface reverse rollers 60 through the fixing discharge sheet sensor 62 (described later) and the pair of first surface reverse rollers 59.

A discharging portion is constituted by a normal discharge path 64, a second discharge path 65 disposed between the pair of first surface reverse rollers 59 and the pair of second surface reverse rollers 60, three bin trays 40, 41, 42 (as discharge ports), and flappers (as rotary members of conveying path changing members)26, 31 for directing the sheet to the discharge paths. Now, the face-down discharging of the sheet onto the tray 40 will be explained (The surface reverse position is A.).

When a signal for demanding that the sheet of which size is previously known is discharged onto the tray 40 in a face-down discharge fashion is received, even after the fixing discharge sheet sensor 62 detects the leading end of the sheet, the flapper (rotary member) 26 remains at a position shown by the solid line (26*b*) and a distal end 29*a*' of a PET sheet 29*a* (guide member (guide piece) having elasticity and adhered to a guide piece attaching member 29*b* provided on the flapper 26) is in pressure contact with an inner wall of the sheet conveying path 80.

By providing such an arrangement of the conveying path changing member, even if accuracy of the rotary member is poor more or less, since the guide piece having the elasticity covers such poor accuracy, the conveying path can surely be changed.

Further, since the guide piece 29*a* abuts against the inner wall of the conveying path with moderate flexion, a longitudinal configuration of the guide piece may not be made completely uniform, so long as such a configuration can be urged against the inner wall over the entire length of the guide piece.

After a predetermined time period is elapsed, the stepping motors for driving the pair of first surface reverse rollers 59 and the pair of second surface reverse rollers 60 are driven in a forward rotating direction to convey the sheet toward a downstream direction. In this case, the sheet advances while pushing the distal end 29*a*' of the PET sheet 29*a*. When a predetermined time period Ta is elapsed after the trailing end of the sheet is detected by the fixing discharge sheet sensor 62, the pair of first surface reverse rollers 59 and the pair of second surface reverse rollers 60 are rotated reversely to feed the sheet back toward an upstream direction. The predetermined time period Ta is defined by the following equation:

$$Ta=[(\text{distance } La)/\text{conveying speed}]$$

(La: refer to FIG. 2)

In this way, the front surface and the back surface of the sheet is reversed at the surface reverse position B. In this case, since the flapper 31 is provided with the PET sheet 31*a*, by the guidance of the PET sheet 31*a*, the sheet can be conveyed toward a direction indicated by the arrow Q is that the face-down sheet can be discharged onto the tray 41 or 42.

Also when a both-face print signal is received, a similar operation is effected. When a predetermined time period Tc (indicated by the following equation) is elapsed, the pair of second surface reverse rollers 60 are rotated reversely:

$$Tc=[(\text{distance } Lc)/\text{conveying speed}]$$

(Lc: refer to FIG. 2)

In this way, the front surface and the back surface of the sheet is reversed at the surface reverse position C. In this case, since a PET sheet 51*a* is provided on one end of an upper guide 51 of the both-face tray 50, the sheet can be conveyed toward a direction indicated by the arrow R so that the sheet can be discharged onto the both-face tray 50.

In the above-mentioned explanation, the flappers (rotary members) 26, 31 and the PET sheets (guide pieces) 29*a*, 31*a* provided on the flappers 26, 31 constitute conveying path changing members 32, 33, and the conveying path changing members 32 is rotatably disposed at a branched portion 81 between the sheet conveying path 80 and a first discharge path (sheet surface reverse conveying path) 64, and the conveying path changing member 33 is rotatably disposed at a branched portion 82 between the sheet conveying path 80 and a second discharge path (sheet surface reverse conveying path) 65.

The PET sheets as guide members (guide pieces) having elasticity which are characteristics of the illustrated embodiment are used in the three surface reverse positions A, B, C. A securing method and a using methods at three positions will now be described concretely.

Figure 3:
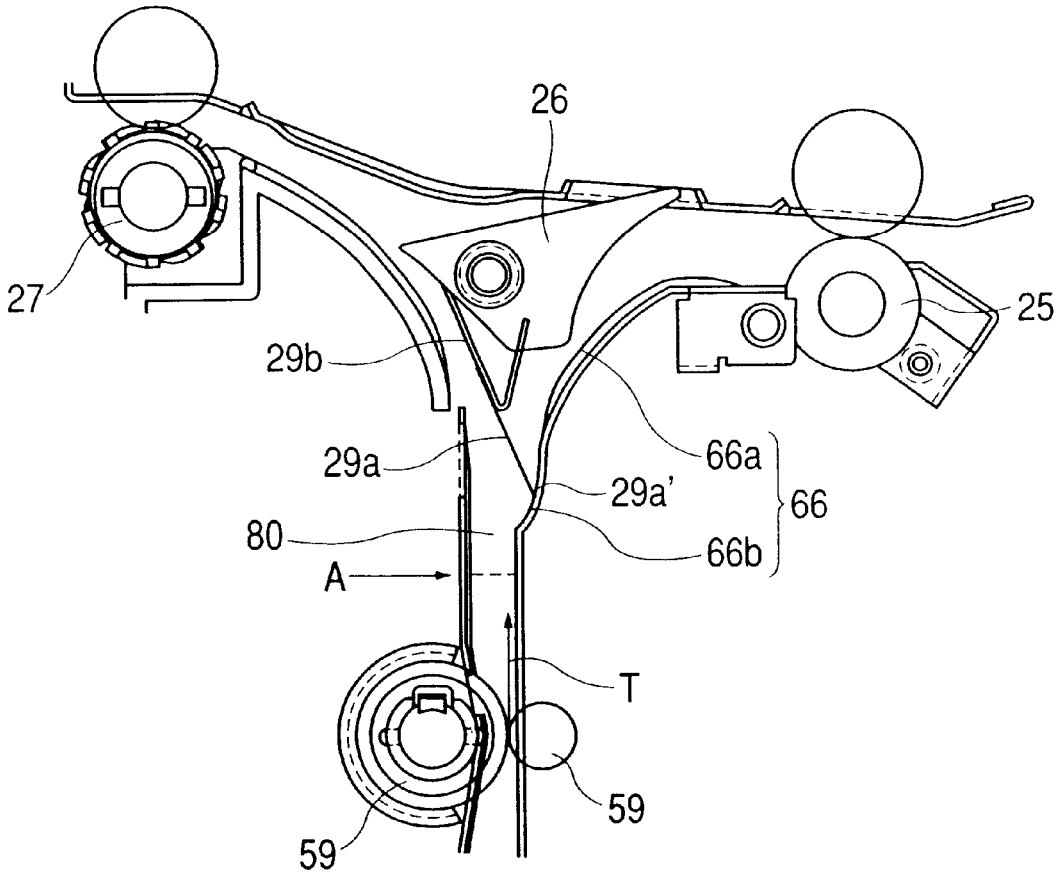
FIG. 3 is an enlarged view showing a surface reverse position A and therearound.
Figure 4:
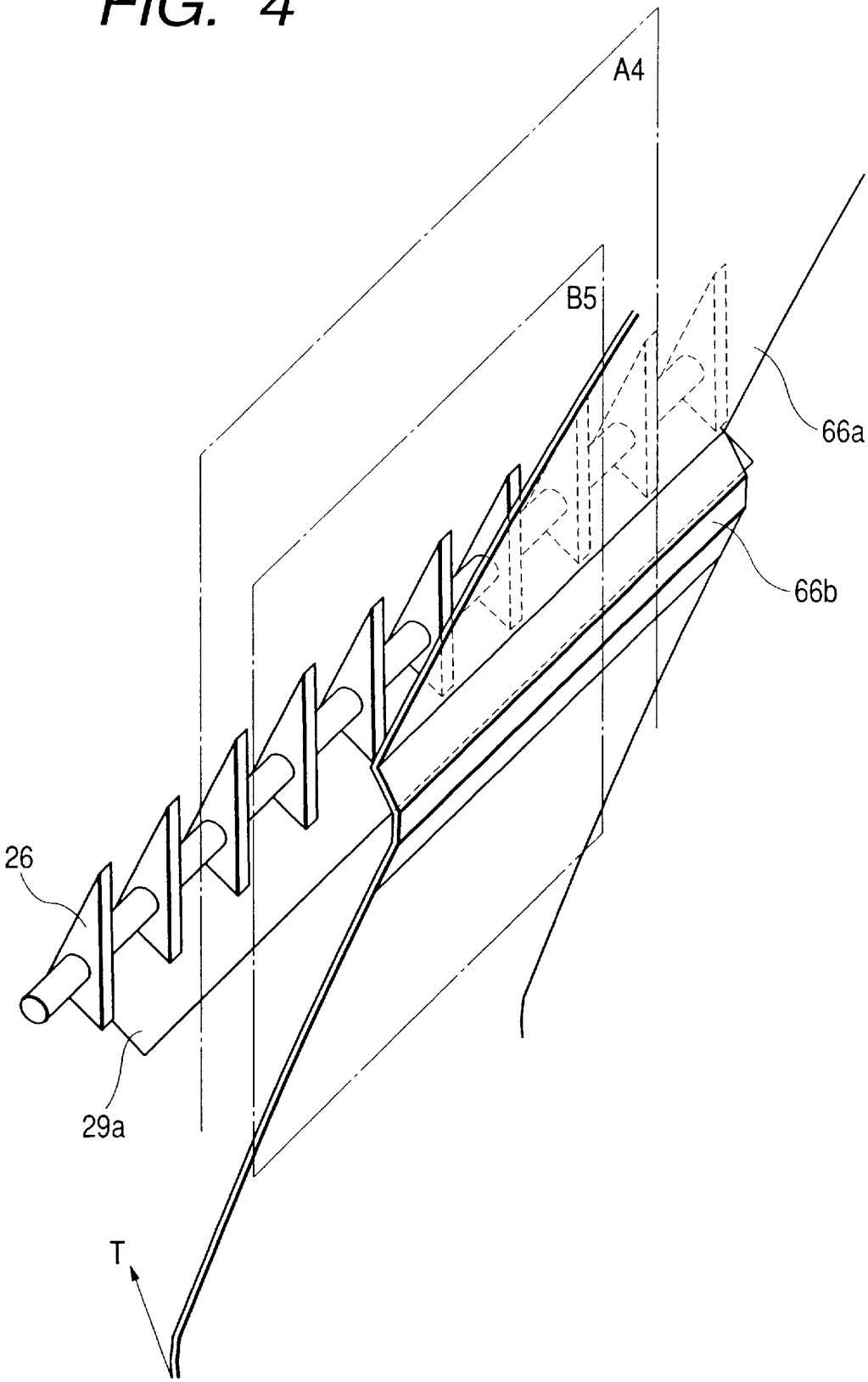
FIG. 4 is a perspective view of a portion for reversing and discharging of a sheet in the surface reverse position A.

First of all, the surface reverse position A and therearound will be explained with reference to FIGS. 2, 3 and 4 (perspective view).

The PET sheet 29*a* is disposed to abut against a recessed portion 66*b* formed in an intermediate area of a curved portion 66*a* of a guide 66 forming a part of a conveying path between the roller 25 and the pair of rollers 59. Incidentally, the curved portion 66*a* is curved to protrude into the conveying path 80. The surface reverse position A is arranged in the vicinity of a terminal portion of the curved portion 66*a* of the guide 66 which is transition of the sheet convey path 80 from a horizontal path to a vertical path thereof. In the illustrated embodiment, the curved portion 66*a* and the recessed portion 66*b* form interference avoiding members, respectively and constitute interference avoiding means.

Explaining the movement of the sheet concretely, at the moment when a trailing end (i.e., leading end after reversing) of the sheet held by the pair of first surface reverse rollers 59, the PET sheet 29*a* having uniform longitudinal configuration and the guide gap between the flapper 26 and the guide 66 leaves the PET sheet 29*a*, the trailing end is released at once by the rigidity of the sheet to be oriented along a tangential line T between the rollers 59. Since a tangential line on the terminal portion of the curved portion 66*a* of the guide 66 is also directed substantially along the line T, the distal end 29*a*' of the PET sheet 29*a* is concealed by the curved portion 66*a* when looking in the direction of the tangential line of the pair of first surface reverse rollers 59 (opposite to the surface reverse conveying path with respect to the tangential line T), so that, during the surface reversing, the leading end of the sheet can be prevented from being caught by the distal end 29*a*' of the PET sheet 29*a*.

Further, in the illustrated embodiment, since the distal end 29*a*' of the guide piece 29*a* is received in the recessed portion 66*b* of the curved portion 66*a* so that the distal end 29*a*' is further retracted, the leading end of the sheet can be prevented from being caught by the distal end 29*a*' of the guide piece 29*a* more securely.

Figure 12:
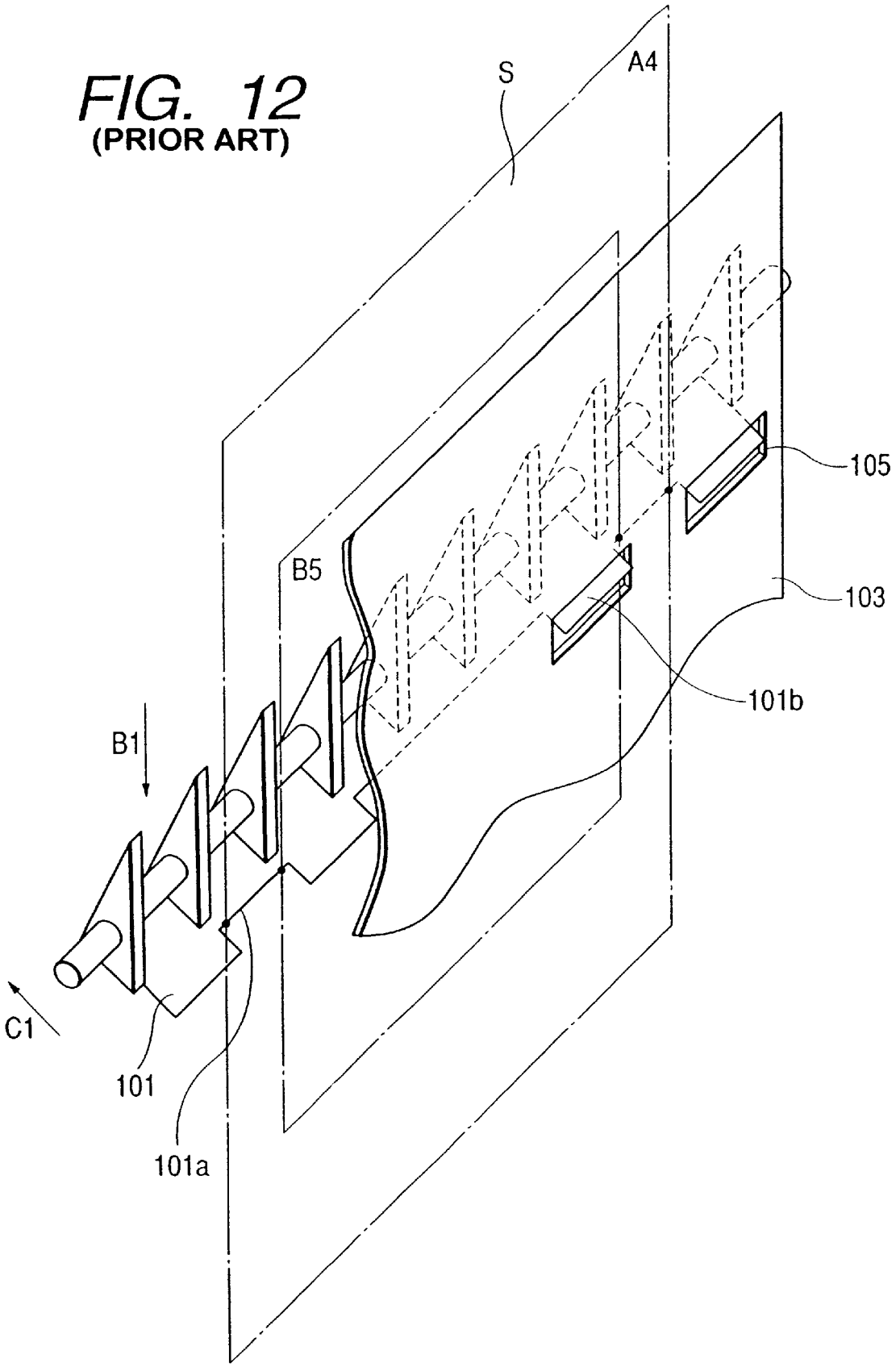
FIG. 12 (PRIOR ART)
FIG. 12 is a perspective view only showing main portions of a conventional sheet surface reversing device.

Further, since the guide piece having the substantially uniform longitudinal configuration can be used, there is no problem of catching the sheet by deformed protruded portions or recessed portions of the pectination shape, which would occur in the conventional guide piece having such pectination shape. Further, since there is no holes through which distal ends of Mylar are protruded as shown in FIG. 12, there is no problem of catching the sheet by the holes.

Figure 5:
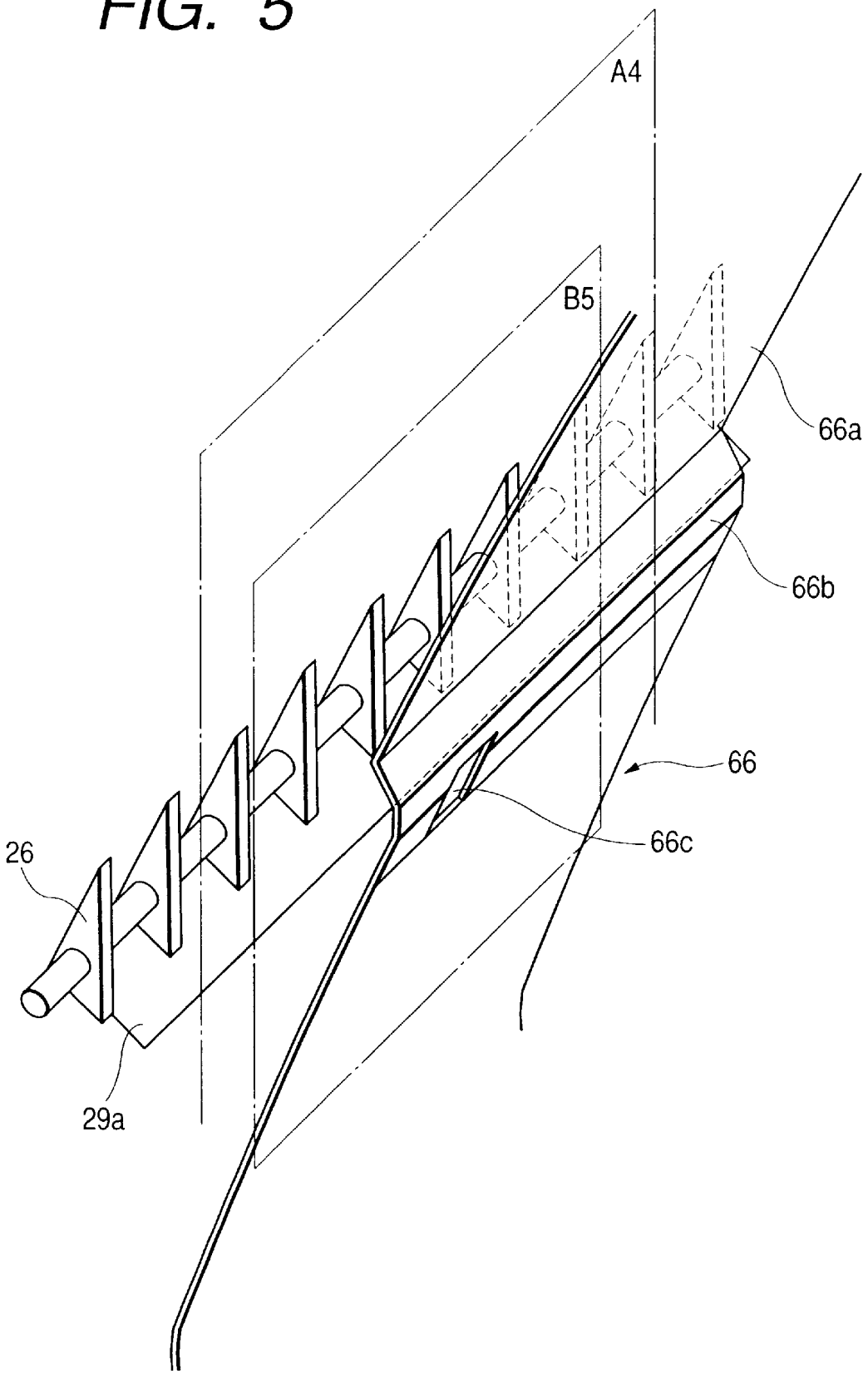
FIG. 5 is a perspective view of a portion for reversing and discharging of a sheet in the surface reverse position A.

However, as shown in FIG. 5, although a sensor hole 66*c* for sheet detection is formed in the guide 66, so long as such a hole is disposed not to interfere with the side edges of the sheet and has a dimension to the extent of the size used for the sensor, the effect of the present invention is not worsened. In the illustrated embodiment, while the combination of the curved portion 66*a* and the recessed portion 66*b* was explained, even when these portions are used independently, adequate effect can be expected.

Figure 6A:
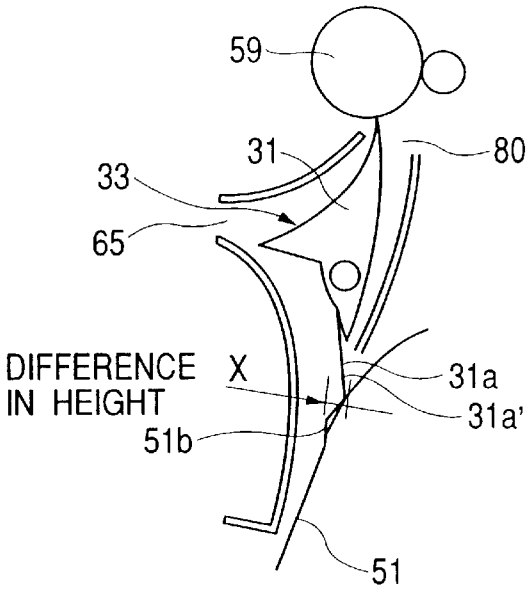
FIG. 6A is a detailed view of a portion for reversing and discharging of a sheet in a surface reverse position B.
Figure 6B:
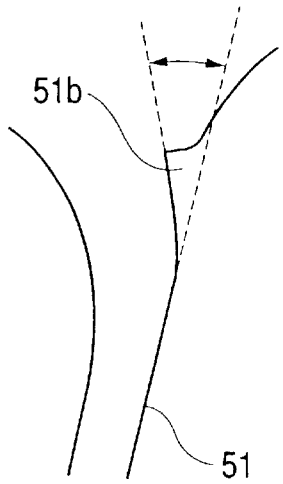
FIG. 6B is an enlarged view of a protruded portion 51*b;*
Figure 6C:
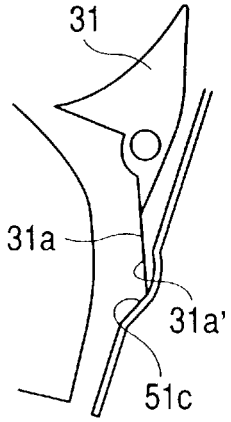
FIG. 6C is a detailed view of another embodiment of a portion for reversing and discharging of a sheet in the surface reverse position B.

Next, the surface reverse position B and therearound will be explained with reference to FIGS. 6A, 6B and 6C.

The characteristic of the surface reverse position B is that a smooth projection (as interference avoiding member (means) 51*b* is provided at a point immediately downstream side of an area of guide 51 opposed to the distal end 31*a*' of the PET sheet (guide member) 31*a* adhered to the flapper (rotary member) 31 in such a manner that the projection 51*b* does not impede bidirectional conveyance ability of the sheet. The distal end of the PET sheet abuts against the guide 51 upstream of the projection 51*b* in the sheet conveying direction. Incidentally, as shown in FIG. 6B, it is desirable that the projection of an angle of about 30 degrees. With this arrangement, the distal end 31*a*' of the PET sheet 31*a* is concealed with respect to the sheet reverse conveying direction, thereby enhancing the prevention of interference of the curled sheet during the surface reversing operation. Since the guide plate has no hole, the leading end of the sheet is not caught by the guide plate. Further, when a difference X in height between the projection 51*b* and the distal end 31*a*' of the PET sheet 31*a* is increased, the prevention of interference can be ensured more positively (FIG. 6A). Incidentally, in place of the projection 51*b*, a recessed portion 51*c* as a interference avoiding member (means) may be formed in the area of the guide 51 opposed to the distal end 31*a*' of the PET sheet 31*a* (FIG. 6C). In this case, since the sheet passes over the distal end 31*a*' of the PET sheet 31*a*, the same effect as that in the embodiment shown in FIG. 6A can be achieved.

Incidentally, so long as a height of the projection 51*b* is greater than a predetermined value, it is not necessary that the height of the projection is uniform along the longitudinal direction. For example, an arrangement in which a height at a longitudinal end in which the curl of the sheet is considered to become great is particularly increased. Also regarding the recessed portion 51*c*, for the same reason, so long as a depth of the recessed portion is greater than a predetermined value, it is not necessary that the depth of the recessed portion is uniform along the longitudinal direction.

By providing the smooth step downstream of the area of the guide plate opposed to the distal end 31*a*' of the PET sheet 31*a* in this way, the conveyance ability for the curled sheet can b enhanced.

Figure 7:
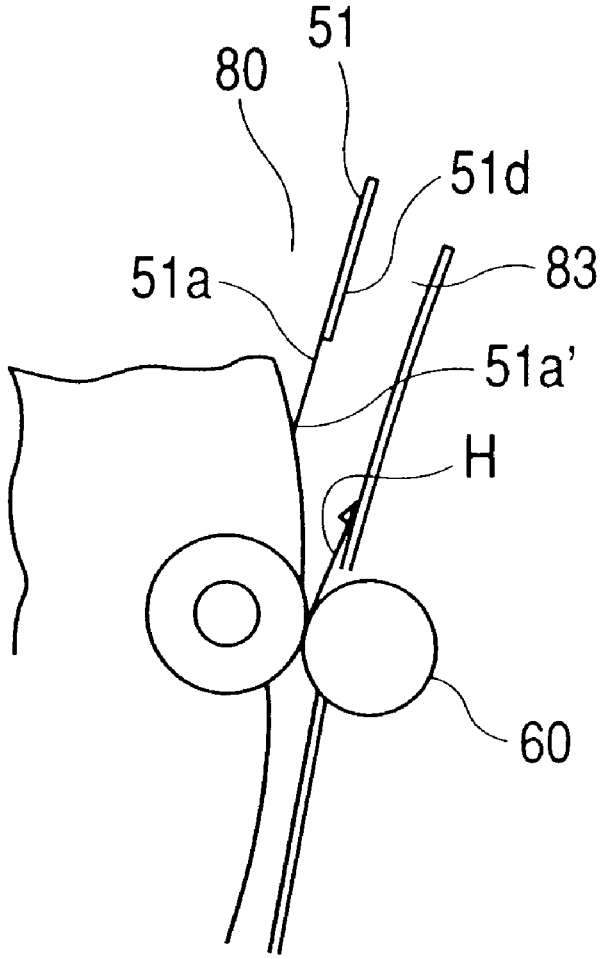
FIG. 7 is a detailed view of a portion for reversing and discharging of a sheet in a surface reverse position C.
Figure 8:
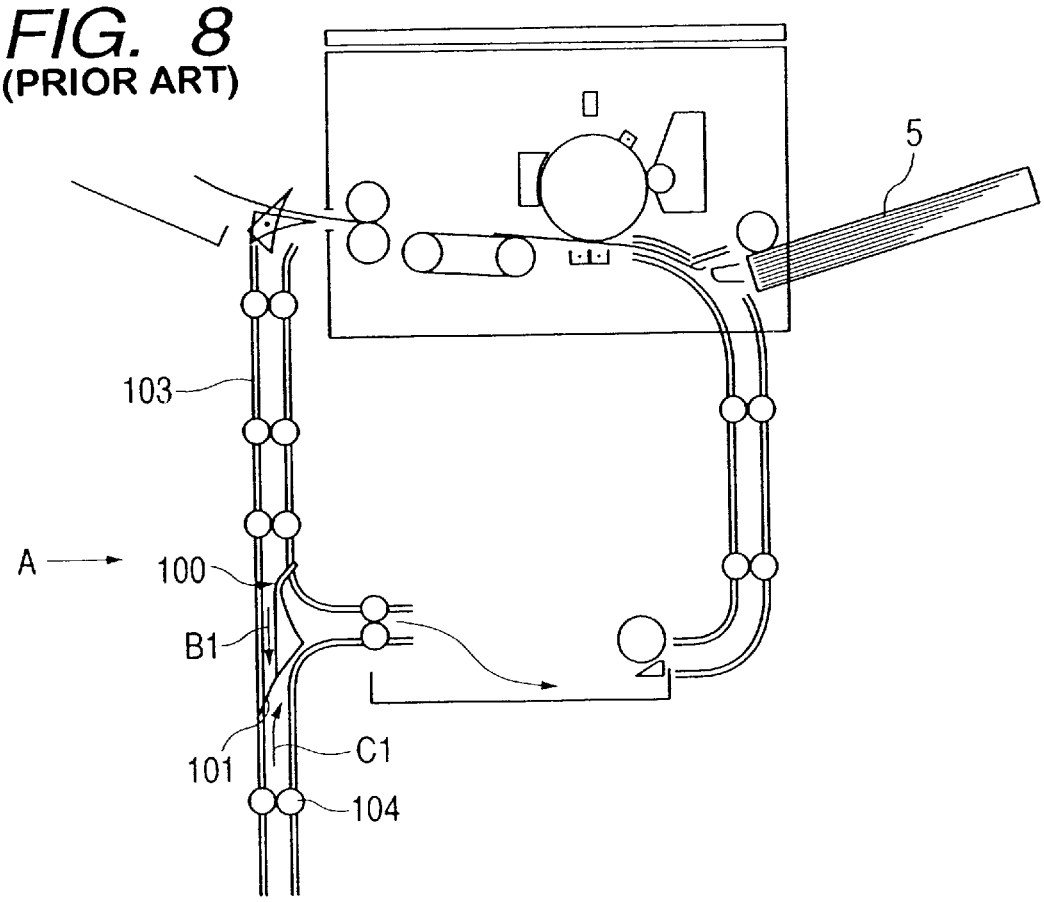
FIG. 8 (PRIOR ART)
FIG. 8 is a schematic front sectional view only showing main portions of a conventional sheet surface reversing device.
Figure 9:
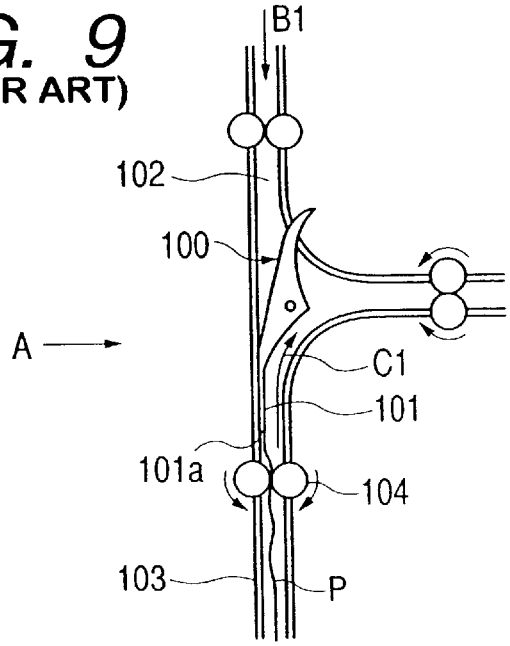
FIG. 9 (PRIOR ART)
FIG. 9 is a schematic front sectional view only showing main portions of a conventional sheet surface reversing device.
Figure 10:
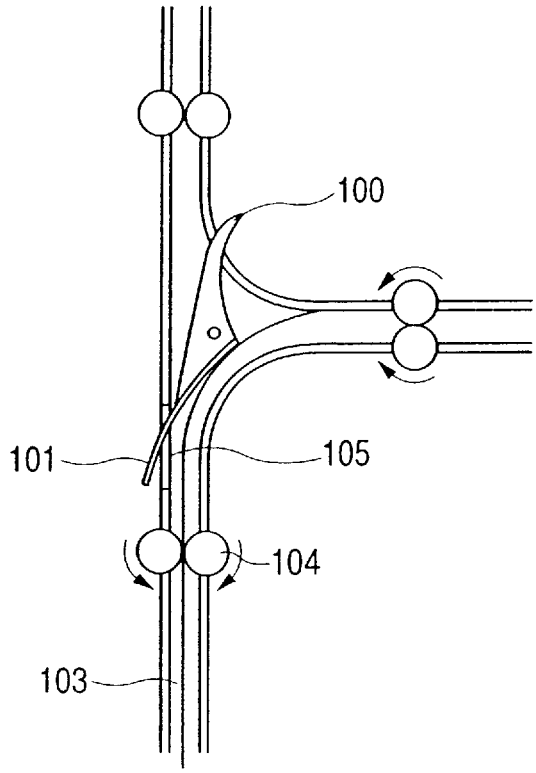
FIG. 10 (PRIOR ART)
FIG. 10 is a view showing main portions of another conventional sheet surface reversing device.
Figure 11:
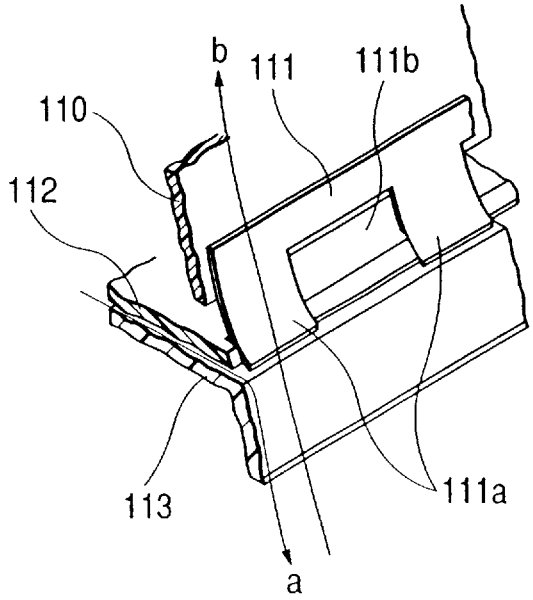
FIG. 11 (PRIOR ART)
FIG. 11 is a view showing main portions of another conventional sheet surface reversing device.

Lastly, the surface reverse position C will be explained with reference to FIG. 7.

When the sheet conveyed through the sheet conveying path 80 passes by a branched portion 51*d* while pushing the distal end 51*a*' of the PET sheet (reverse feed preventing member having elasticity) 51*a*, the PET sheet 51*a* is restored to its original state by its elasticity, thereby closing or blocking the sheet conveying path 80 at the branched portion 51*d*.

Thereafter, the pair of second surface reverse rollers (rotary members) 60 are rotated reversely to feed the sheet reversely. In this case, since a common tangential line H of the pair of second surface reverse rollers 60 (tangential line at the nip between these rollers) is oriented toward a sheet surface reverse conveying path 83 to the both-face tray 50, the pair of second surface reverse rollers 60 guide the sheet into the sheet surface reverse conveying path 83 while feeding the sheet reversely.

Accordingly, since the common tangential line H of the pair of second surface reverse rollers 60 is oriented toward the sheet surface reverse conveying path 83, and since the distal end 51*a*' of the PET sheet 51*a* is located at a position opposite to the sheet surface reverse conveying path 83 with respect to the common tangential line H, a leading end of the sheet conveyed reversely (trailing end of the sheet when it is conveyed through the sheet conveying path) is prevented from abutting against the distal end 51*a*'. In this way, the sheet is guided into the sheet surface reverse conveying path 83 in a switch-back fashion, thereby preventing the sheet from being jammed. Further, as is in the illustrated embodiment, by using the reverse feed preventing member 51*a*, even when the sheet has great curl, the sheet can be guided into the sheet reverse conveying path 83 more securely.

Incidentally, when this arrangement is combined with the interference avoiding members such as the guide curved portion 661, the recessed portion 66*b*, the projection 51*b* and the recessed portion 51*c* in the aforementioned embodiments, more reliable sheet jam preventing effect can be achieved.

As mentioned above, in the sheet surface reversing device according to the present invention, by the provision of the interference avoiding means, since the leading end of the sheet fed reversely passes over the rotating distal end of the conveying path changing member to avoid the interference between the leading end of the sheet and the rotating distal end of the conveying path changing member, the sheet fed reversely can be guided into the sheet surface reverse conveying path smoothly. As a result, the sheet jam and sheet damage due to the switching of the conveying path changing member can be prevented. Further, the sheet surface reversing device can be made compact and simplified.

Further, in the sheet surface reversing device according to the present invention, since the guide member abutting against the inner wall of the sheet conveying path has elasticity, the rotating distal end of the guide member is closely contacted with the inner wall of the sheet conveying path not to protrude from the interference avoiding means, so that the interference between the leading end of the sheet fed reversely and the distal end of the guide member can surely be avoided. Further, when the longitudinal configuration of the guide member is made substantially uniform, the catching of the sheet can be prevented more securely.

Further, since the image forming apparatus according to the present invention has the above-mentioned sheet surface reversing device, the sheet on which the image is formed can surely be discharged out of the main body of the image forming apparatus.

What is claimed is:

1. A sheet surface reversing device comprising:

a sheet conveying path through which a sheet is conveyed;

a pair of rotary members for reversely feeding the sheet conveyed through said sheet conveying path;

a sheet surface reverse conveying path to which the sheet is reversely fed, said sheet surface reverse conveying path being branched from said sheet conveying path; and an elastic reverse feed preventing member provided at a branched portion between said sheet conveying path and said sheet surface reverse conveying path and having a substantially uniform longitudinal configuration, so as to permit conveyance of the sheet from said sheet conveying path to said pair of rotary members and to permit entering of the sheet into said sheet surface reverse conveying path while preventing entering of the sheet from said pair of rotary members into said sheet conveying path, wherein said pair of rotary members are arranged so that a tangential line on a nip of said pair of rotary members is oriented toward a wall of said sheet surface reverse conveying path, which is branched from said sheet conveying path.

2. A sheet surface reversing device comprising:

a sheet conveying path through which a sheet is conveyed;

reverse feeding means having a pair of rotary members for reversely feeding the sheet conveyed through said sheet conveying path;

a sheet surface reverse conveying path to which the sheet reversely fed by said reverse feeding means is directed, said sheet surface reverse conveying path being branched from said sheet conveying path;

a conveying path changing member rotatably disposed at a branched portion between said sheet conveying path and said sheet surface reverse conveying path; wherein in a state that a distal end of said conveying path changing member abuts against an inner wall of said sheet conveying path, the sheet reversely fed is guided into said sheet surface reverse conveying path; and interference avoiding means for avoiding interference between the sheet reversely fed and said distal end of said conveying path changing member provided on said inner wall of said sheet conveying path, and an abutment position of said distal end of said conveying path changing member against said inner wall is upstream of said interference avoiding means in said sheet conveying path and opposite to said sheet surface reverse conveying path with respect to a tangential line on a nip of said pair of rotary members, and wherein said pair of rotary members are arranged so that the tangential line on the nip of said pair of rotary members is oriented toward a wall of said sheet surface reverse conveying path, which is branched from said sheet conveying path.

3. A sheet surface reversing device according to claim 2, wherein said conveying path changing member includes a rotatable rotary member provided at said branched portion, and an elastic guide member is provided on said rotary member for abutting against said inner wall.

4. A sheet surface reversing device according to claim 3, wherein a longitudinal configuration of said guide member is made substantially uniform so that said guide member abuts against said inner wall over a length of said guide member in a longitudinal direction of said guide member.

5. A sheet surface reversing device according to any one of claims 2 to 4, wherein said interference avoiding means comprises a curved portion of said inner wall curved to protrude into said sheet conveying path, and said distal end of said conveying path changing member abuts against an intermediate portion of said curved portion.

6. A sheet surface reversing device according to any one of claims 2 to 4, wherein said interference avoiding means comprises a protrusion protruding from said inner wall, and said distal end of said conveying path changing member abuts against an area upstream of said protrusion in said sheet conveying path.

7. A sheet surface reversing device according to any one of claims 2 to 4, wherein said interference avoiding means comprises a recessed portion formed in said inner wall, and said distal end of said conveying path changing member abuts against said recessed portion.

8. A sheet surface reversing device according to any one of claims 2 to 4, wherein said interference avoiding means comprises a curved portion of said inner wall curved to protrude into said sheet conveying path and a protrusion protruding from said inner wall in said curved portion, and said distal end of said conveying path changing member abuts against an area upstream of said protrusion in said sheet conveying path.

9. A sheet surface reversing device according to any one of claims 2 to 4, wherein said interference avoiding means comprises a curved portion of said inner wall curved to protrude into said sheet conveying path and a recessed portion formed in said inner wall in said curved portion, and said distal end of said conveying path changing member abuts against said recessed portion.

10. A sheets surface reversing device according to claim 1, wherein said elastic reverse feed preventing member includes a rotatable rotary member provided at said branched portion, and an elastic guide member provided on said rotary member for abutting against an inner wall of said sheet conveying path.

11. A sheet surface reversing device according to claim 10, wherein a longitudinal configuration of said guide member is made substantially uniform so that said guide member abuts against said inner wall over a length of said guide member in a longitudinal direction of said guide member.

12. A sheet surface reversing device according to any one of claims 1, 10, or 11, further comprising interference avoiding means for avoiding interference between the sheet reversely fed and a distal end of said elastic reverse feed preventing member, wherein said interference avoiding means comprises a curved portion protruding into said sheet conveying path, and said distal end of said elastic reverse feed preventing member abuts against an intermediate portion of said curved portion.

13. A sheet surface reversing device according to any one of claims 1, 10, or 11, further comprising interference avoiding means for avoiding interference between the sheet reversely fed and a distal end of said elastic reverse feed preventing member, wherein said interference avoiding means comprises a protrusion protruding into said sheet conveying path, and said distal end of said elastic reverse feed preventing member abuts against an area upstream of said protrusion in said sheet conveying path.

14. A sheet surface reversing device according to any one of claims 1, 10, or 11, further comprising interference avoiding means for avoiding interference between the sheet reversely fed and a distal end of said elastic reverse feed preventing member, wherein said interference avoiding means comprises a recessed portion formed in an inner wall of said sheet conveying path, and said distal end of said elastic reverse feed preventing member abuts against said recessed portion.

15. A sheet surface reversing device according to any one of claims 1, 10, or 11, further comprising interference avoiding means for avoiding interference between the sheet reversely fed and a distal end of said elastic reverse feed preventing member, wherein said interference avoiding means comprises a curved portion protruding into said sheet conveying path and a protrusion protruding into said sheet conveying path on said curved portion, and said distal end of said elastic reverse feed preventing member abuts against an area upstream of said protrusion in said sheet conveying path.

16. A sheet surface reversing device according to any one of claims 1, 10, or 11, further comprising interference avoiding means for avoiding interference between the sheet reversely fed and a distal end of said elastic reverse feed preventing member, wherein said interference avoiding means comprises a curved portion protruding into said sheet conveying path and a recessed portion formed in said curved portion, and said distal end of said elastic reverse feed preventing member abuts against said recessed portion.

17. An image forming apparatus comprising:

image forming means for forming an image on a sheet; and a sheet surface reversing device for reversing surfaces of the sheet on which the image is formed by said image forming means and conveying the sheet, wherein said sheet surface reversing device is a sheet surface reversing device recited in any one of claims 1, 2, 3, 4, 10, or 11.

* * * * *

UNITED STATES PATENT AND TRADEMARK OFFICE

CERTIFICATE OF CORRECTION

PATENT NO. : 6,398,212 B1
DATED : June 4, 2002
INVENTOR(S) : Hiroaki Miyake

It is certified that error appears in the above-identified patent and that said Letters Patent is hereby corrected as shown below:

Column 6,
Line 25, “is” should read -- are --.

Column 8,
Line 11, “b” should read -- be --.

Column 10,
Line 1, “are” should read -- is --.
Line 48, “sheets” should read -- sheet --.

Signed and Sealed this

Twenty-seventh Day of August, 2002

*Attest:*

*Attesting Officer*

JAMES E. ROGAN
*Director of the United States Patent and Trademark Office*